United States Patent [19]

Doose

[11] 4,427,197

[45] Jan. 24, 1984

[54] CONSTRUCTION FOR THREE DIMENSIONAL LOGICAL TOY

[76] Inventor: Paul R. Doose, 1903 Greenfield Ave., Los Angeles, Calif. 90025

[21] Appl. No.: 321,767

[22] Filed: Nov. 16, 1981

[51] Int. Cl.[3] ..... A63F 9/08

[52] U.S. Cl. ..... 273/153 S

[58] Field of Search ..... 273/153 R, 153 S, 155

[56] References Cited

U.S. PATENT DOCUMENTS 3,747,932 7/1973 Grissino ..... 273/282 X

FOREIGN PATENT DOCUMENTS 170062 12/1977 Hungary ..... 273/153 S 435718 9/1935 United Kingdom ..... 273/153 S

*Primary Examiner*—Anton O. Oechsle

*Attorney, Agent, or Firm*—William H. Maxwell

[57] ABSTRACT

A three dimensional game cube of selectively moveable surface blocks and each side of the cube comprised of a center block, four corner blocks and an edge block adjacent the center block between each pair of corner blocks, the corner and edge blocks of adjacent sides of the cube being common one with the other, the cube being truncated on three pairs of parallel planes separating the blocks moveably held in operating positions by a cross within a spherical cavity, interface sides of said surface blocks having inclined surfaces engageable for realignment and sliding one against the other.

22 Claims, 14 Drawing Figures

FIG. 6.
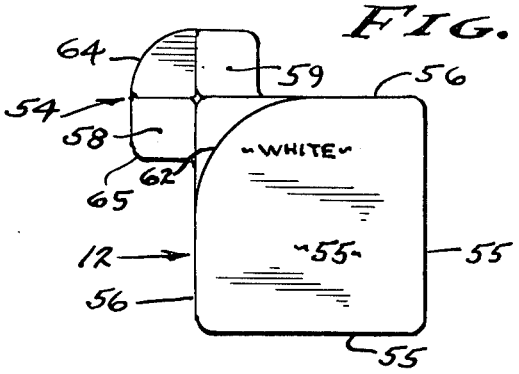
FIG. 5.
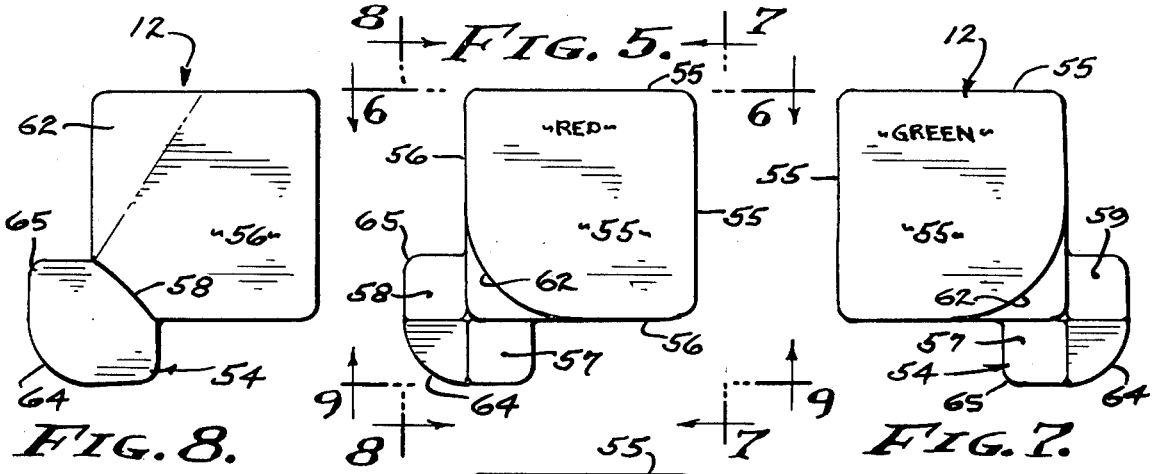
FIG. 8.
FIG. 7.
FIG. 9.
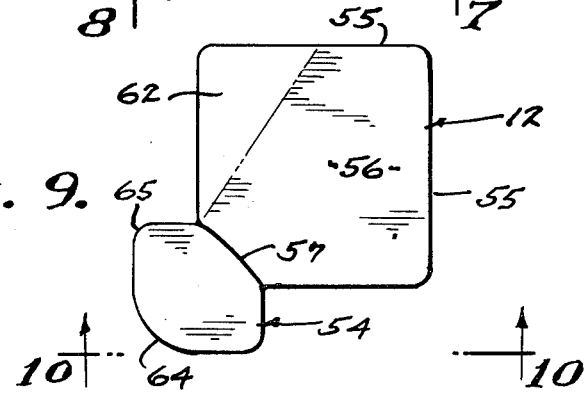
FIG. 10.
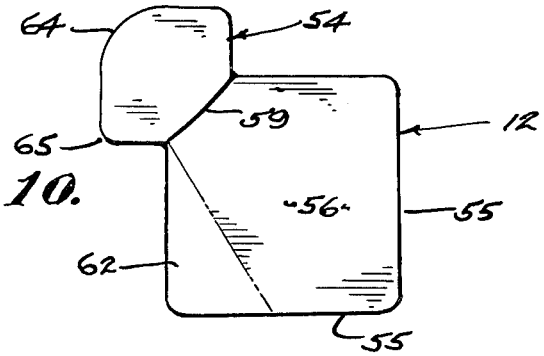

CONSTRUCTION FOR THREE DIMENSIONAL LOGICAL TOY

BACKGROUND

This invention is concerned with a three dimentional logical toy and in particular with the game puzzle known as "Rubik's Cube," a demonstration device which is said to have forty-three quintillion configurations. Generally, the cube is truncated into twenty-six surface blocks which present six groups of distinguishable faces, or fifty-four exposed faces. The said blocks are moveable relative to each other on the planes of truncation and are secured together on three right angularly related axes X, Y and Z. A feature is the rotatable securement on said axes by means of the center blocks that revolve upon a cross and present interior races on the lines of truncation so as to capture the bearing faces of anchors that project inwardly from the blocks. It is a general object of this invention to provide means by which the blocks in any one plane of truncation can be readily and easily rotated and thereby quickly moved relative to the others on any one of the axes X, Y and Z.

Alignment of the truncations about which movement is to occur is essential in three dimensional logical toys of the type under consideration, otherwise obstruction to rotation will exist and thus hamper expediency in solution of the puzzle. Interiorly, the cube is characterized by a spherical cavity with the aforesaid interior races exposed inwardly so as to be engaged by the bearing faces of the anchors. The spherical cavity is comprised of the inner side portions of the center blocks, the inner edge portions of the edge blocks, and the inner corner portions of the corner blocks. The said inner portions of the blocks are spherically truncated and together form the spherical cavity, when aligned. However, any misalignment of the side of the cube to be rotated will disrupt and/or destroy the said spherical cavity configuration and thereby prevent free turning of that side, and also of the four adjacent sides. Misalignment therefore slows the process of solution, it being an object of this invention to establish alignment as a result of rotating the side or sides of the cube, whereby initial alignment is not required. With the present invention, each moveable block of the cube is cam-shaped at its interfaces with adjoining blocks, as will be described, and accordingly a substantial degree of misalignment can be tolerated while deftly and speedily rotating the sides of the cube for the solution required.

It is an object of this invention to greatly improve operability of the three dimensional logical toy, without changing its fundamental construction as it is presently known in the art, whereby rotation of the cube sides in the groups of nine blocks is not hampered by misalignment, even to a substantial degree. In practice, a reasonably close alignment is all that is necessary, whereupon turning of the side of the cube automatically aligns the nine blocks of the side being rotated with the nine blocks of each of the adjoining four sides. The degree of misalignment which may be tolerated is determined by the extent of the cam configuration, a maximum cam configuration being shown and described.

SUMMARY OF THE INVENTION

This invention relates to improvements in the configuration of three dimensional logical toys known as the "Rubik's Cube," whereby alignment of the groups of blocks which comprise each side of the cube are automatically aligned through rotation thereof.

The interface sides of each moveable block are cam-shaped and thereby force the groups of blocks comprising that side into accurate alignment for continued turning, all without exerting excessive force which might otherwise overstress the aforesaid anchors and cause breakage. The center blocks are provided with four cams. The edge blocks are each provided with two cams, one at each adjacent side face of said block. And, the corner blocks are each provided with three cams, one at each adjacent corner face of said block. It is these cams which expedite operation of the cube puzzle, all as hereinafter shown and described.

The foregoing and other various objects and features of this invention will be apparent and fully understood from the following detailed description of the typical preferred form and application thereof, throughout which description reference is made to the accompanying drawings.

DRAWINGS

FIG. 1 is a three dimensional logical toy embodying the construction of the present invention.

FIGS. 2 and 3 are enlarged sectional views taken as indicated by lines 2—2 and 3—3 on FIG. 1.

FIG. 4 is an enlarged detailed perspective view showing the cross and center block relationship on the three axes of rotation.

FIGS. 5, 6 and 7 are orthographic projections showing the outside faces of a corner block, FIG. 5 of a first corner face distinguished for example by the color red, FIG. 6 of a second corner face distinguished for example by the color white and taken as indicated by line 6—6 on FIG. 5, and of a third corner face distinguished for example by the color green and taken as indicated by line 7—7 on FIG. 5.

FIGS. 8, 9 and 10 are orthographic projections showing the inner sides of the corner block of FIG. 5, FIG. 8 of a first inner face and taken as indicated by line 8—8 on FIG. 5, FIG. 9 of a second inner face and taken as indicated by line 9—9 on FIG. 5, and FIG. 10 of a third inner face and taken as indicated by line 10—10 on FIG. 5.

Figure 14:
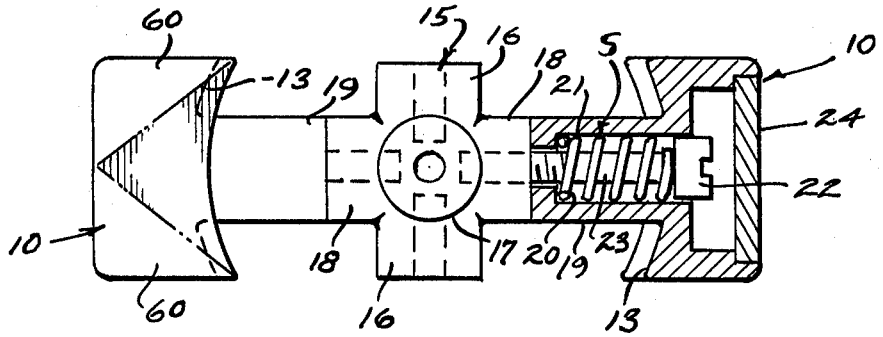

And FIG. 14 is a partial sectional view of the cross and center block coupling detail.

PREFERRED EMBODIMENT

Referring now to the drawings, the cube toy is a rectangular solid having six identical sides divided into nine equally square faces by means of three parallel pairs of right angularly related truncation planes dividing the cube into twenty six surface blocks with fifty four exposed faces. Each block is also a rectangular solid having six like sides, and in accordance with this invention the exposed sides thereof are basically square while the interface sides (adjacent block walls) are modified as later described. The interior of the cube is comprised of a spherical cavity 13 that truncates all of the surface blocks and namely the six center blocks 10, the twelve edge blocks 11, and the eight corner blocks 12. Accordingly, the interior cavity 13 is of a radius or diameter to significantly cut through the inner corner portion of each corner block 12 (opposite the outer corners) so that approximately one third of each of the three inner edges of the corner block 12 is removed. With the interior cavity 13 proportioned as shown and above described, approximately one third of the inner edge portion (opposite the outer edges) of each edge block 11 is removed; and approximately one half portion (the inner half) of each center block 10 is removed. Thus, each and every surface block (center-edge-corner) is truncated or cut through by the interior wall, or theoretical wall, of the spherical cavity 13 so as to be exposed into said cavity. Each of the aforesaid block truncations forms a portion of the wall of the spherical cavity 13 when that truncated block is in alignment therewith.

The twenty six surface blocks 10, 11 and 12 are operatively joined together about right angularly related X, Y and Z axes passing through pairs of center blocks 10 at opposite sides of the cube respectively. Each center block 10 is rotatable on an axis X, Y or Z as the case may be, being secured to a cross member 15 having a pair of oppositely extending legs 16 on axis X, a pair of oppositely extending legs 17 on axis Y, and a pair of oppositely extending legs 18 on axis Z. A stem 19 extends inwardly from each center block 10 and on the axes X, Y and Z extending diametrically of the interior cavity 13, the stem 19 being coupled to a leg of the cross by spring means S urging the center block inwardly in each instance. As shown, the stem 19 is tubular with an outwardly faced spring seat 20 from which a compression spring 21 is yieldingly urged by a screw head 22 or a shank 23 of which extends therethrough and threads into the supporting leg of the cross member 15. The center block is outwardly open for access to the screw head 22, and is closed by a cover plate 24. It will be observed that all six center blocks 10 are coupled to the cross member as above described, and are biased inwardly in three pairs oppositely disposed on the axes X, Y and Z respectively.

Figure 1:
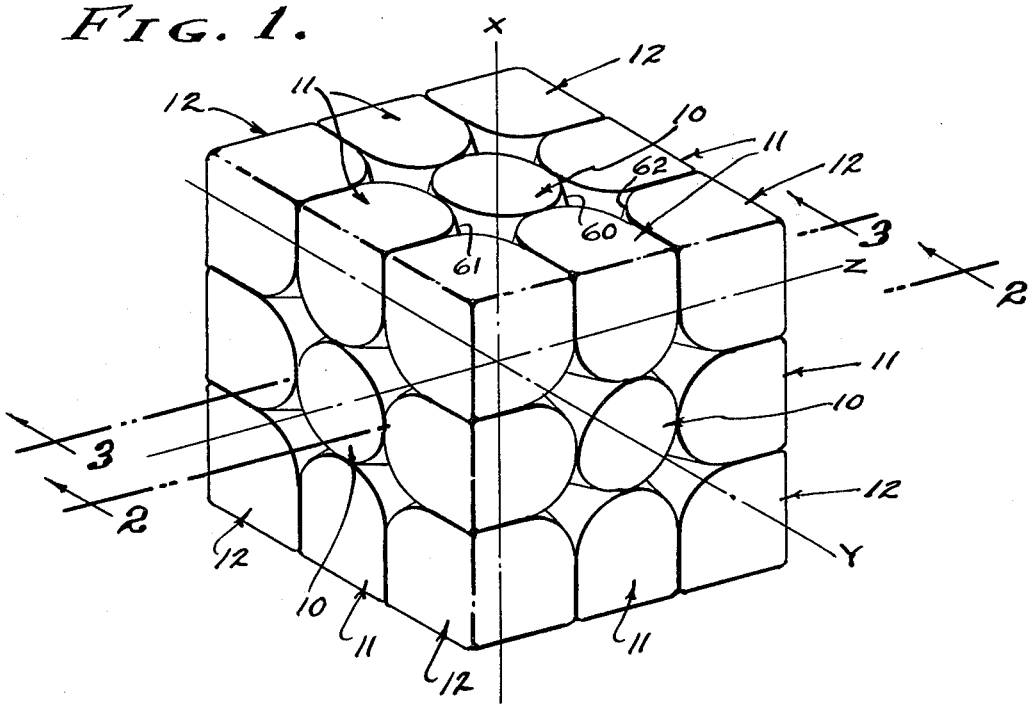
Figure 2:
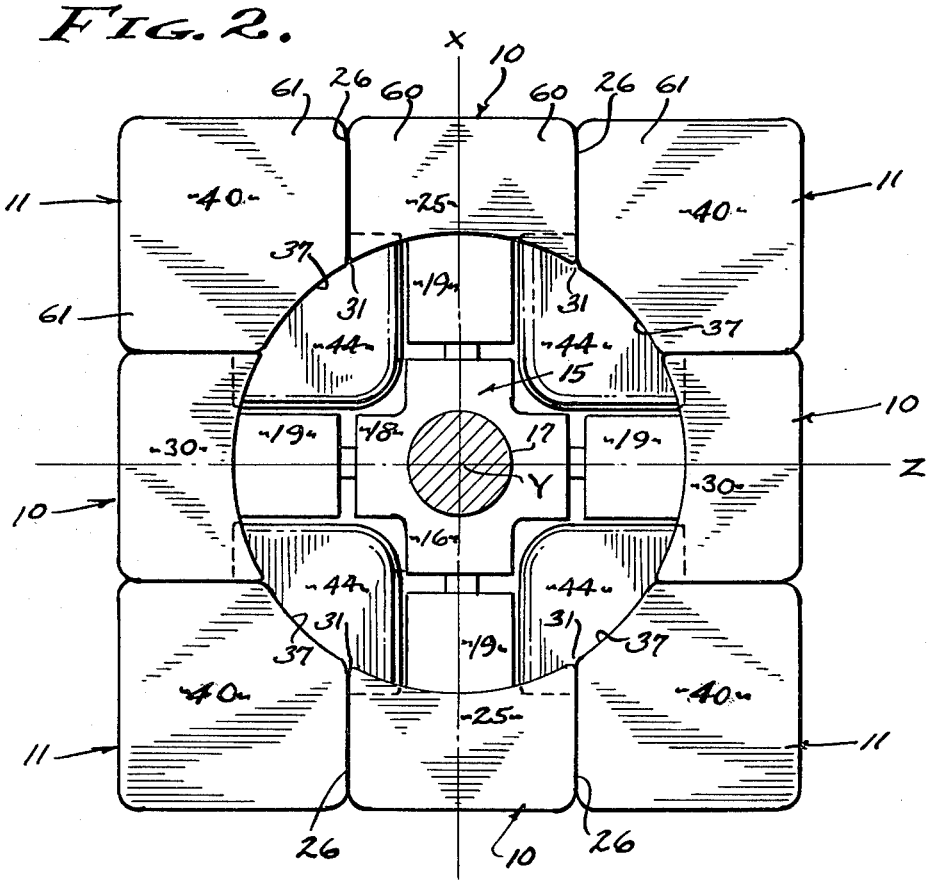
Figure 3:
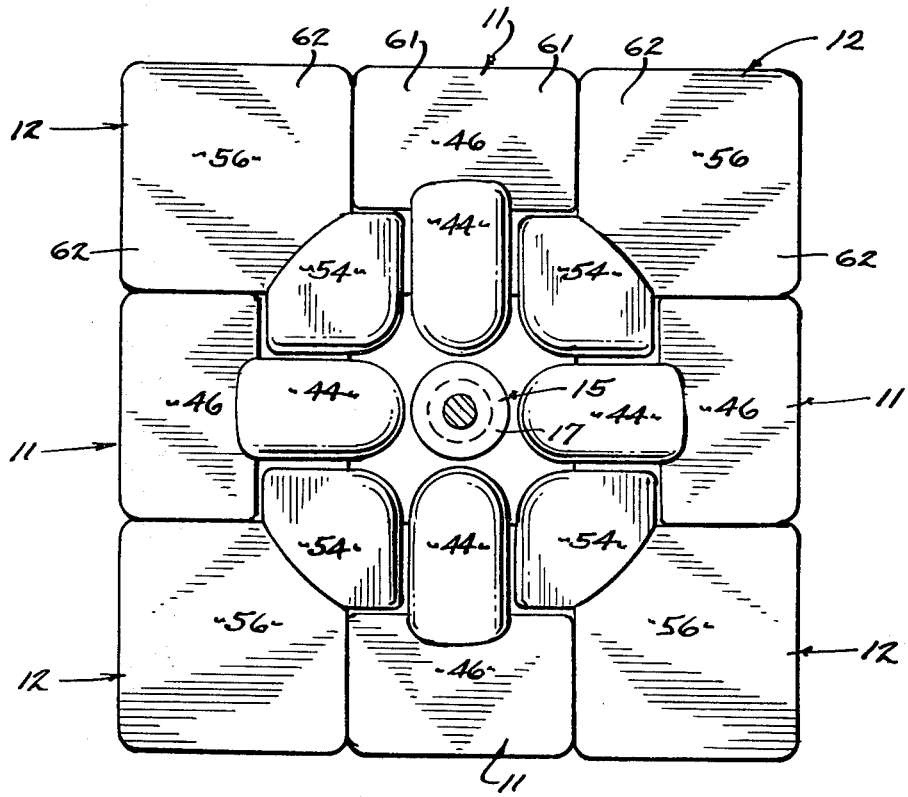
Figure 4:
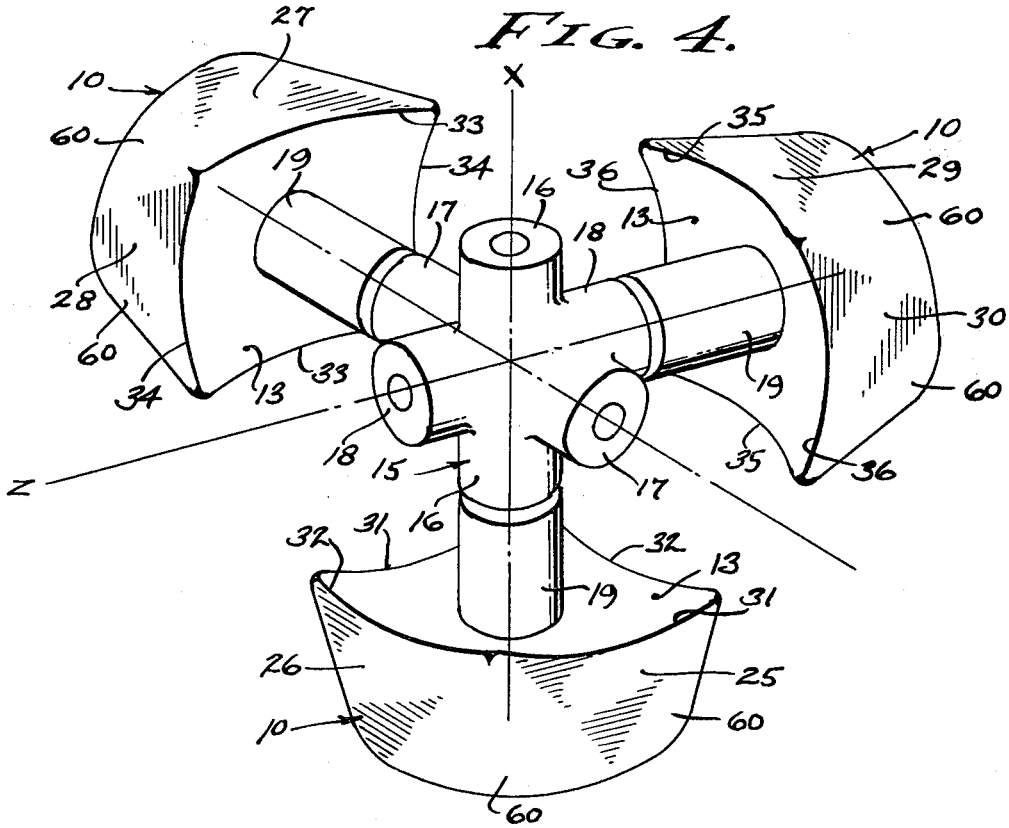
Figure 11:
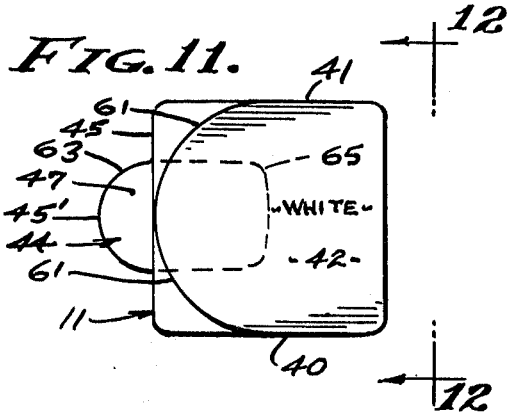
FIGS. 11 and 12 are orthographic projections showing the outside face of an edge block, FIG. 11 of a first edge face distinguished for example by the color white, and FIG. 12 of a second edge face distinguished for example by the color red and taken as indicated by line 12—12 on FIG. 11.
Figure 12:
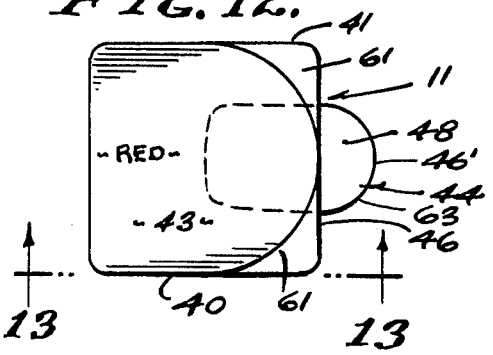
Figure 13:
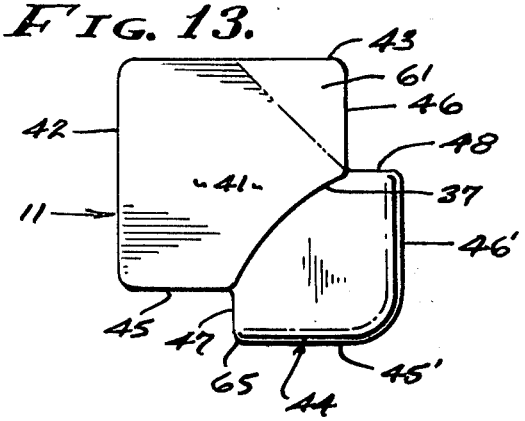
FIG. 13 is a view of one of two like sides and taken as indicated by line 13—13 on FIG. 11.

The twelve edge blocks 11 and eight corner blocks 12 are moveably coupled within the confines of the six center blocks 10 and cross members 15, assembled as described. As best illustrated in FIGS. 2 and 4 of the drawings, the two center blocks 10 on axis X have a first pair of opposite side walls 25 equally spaced from axis X and parallel therewith and with axis Z, and they have a second pair of opposite side walls 26 equally spaced from axis X and parallel therewith and with axis Y, all when said blocks are in alignment as shown. The two center blocks 10 on axis Y have a first pair of opposite side walls 27 equally spaced from axis Y and parallel therewith and with axis Z, and they have a second pair of opposite side walls 28 equally spaced from axis Y and parallel therewith and with axis X, all when said blocks are in alignent as shown. And, the two center blocks on axis Z have a first pair of opposite side walls 29 equally spaced from axis Z and parallel therewith and with axis Y, and they have a second pair of opposite side walls 30 equally spaced from axis Z and parallel therewith and with axis X, all when said blocks are in alignment as shown. The side walls 25-30 of the center blocks 10 are coincidental with the aforesaid three parallel pipes of right angular truncation planes dividing the cube into the twenty six surface blocks.

There are inwardly disposed bearing races formed by the aforesaid truncations of the spherical cavity 13, for the slideable retention of anchors extending inwardly from the blocks 11 and 12 as later described. As shown, the blocks 10 on axis X have concaved bearing races 31 formed at the joined of the spherical cavity 13 truncation with said pairs of walls 25, and they have right angular concaved bearing races 32 formed at the joinder of the spherical cavity 13 truncation with said pairs of walls 26. The blocks 10 on axis Y have concaved bearing races 33 formed at the joinder of the spherical cavity 13 truncation with said pairs of walls 27, and they have right angular concaved bearing races 34 formed at the joinder of the spherical cavity 13 truncation with said pairs of walls 28. And, the blocks 10 on axis Z have concaved bearing races 35 formed at the joinder of the spherical cavity 13 truncation with said pairs of walls 29, and they have right angular concaved bearing races 36 formed at the joinder of the spherical cavity 13 truncation with said pairs of walls 30. The bearing races 31 and 36 of center blocks 10 on axes X and Y are arcuately concentric, while the bearing races 32 and 34 of center blocks 10 on axes X and Y are arcuately concentric, and while the bearing races 33 and 35 of center blocks 10 on axes Y and Z are arcuately concentric. These three groups of bearing races are coincidental with the aforesaid three parallel pairs of right angular truncation planes dividing the cube into the twenty six surface blocks.

In addition to the center block bearing races 31-36 above described, each of the edge blocks 11 has a pair of concaved bearing races 37 formed at the joinder of the spherical cavity 13 truncation with a pair of side walls 40 and 41, and normal to exposed and adjacent outer faces 42 and 43 thereof. There are three groups of bearing races 37 of the edge blocks 11 on the axes X, Y and Z, formed concentric with the aforesaid bearing races 31-36, all of which are coincidental with the aforesaid three parallel pairs of right angular truncation planes dividing the cube into the twenty six surface blocks.

The edge blocks 11 and corner blocks 12 are provided with anchors that are slideably engageable within the aforesaid bearing races 31-36 of the center blocks 10 and races 37 of the edge blocks 11. A feature of the cube is the capability of rotating any side group of nine blocks into alignment with either of the two other axes X, Y and Z. Accordingly, any one block 11 or 12 can be selected to move within the pairs of bearing races 31, 36 and 37, or 32, 34 and 37, or 33, 35 and 37. There are anchors extending inwardly from the edge blocks 11 and corner blocks 12 to engage outwardly against said bearing races, as next described.

The edge block 11 has two outer faces 42 and 43 and has an anchor 44 that extends inwardly between the races 37 and projects laterally from and with inner guide walls 45' and 46' parallel with the inner walls 45 and 46 and offset by outwardly disposed shoulders 47 and 48. These inner guide walls normally clear the cross legs 16 and stems 19 closely when aligned as shown, and they engage adjacent anchors 54. It is these two anchor shoulders 47 and 48 that engage outwardly against the inwardly disposed right angularly related (single line) bearing races 31, 36 and 37, or 32, 34 and 37, or 33, 35 and 37, as required depending upon the selected rotated positions of that edge block 11.

The corner block 12 has three outer faces 55 and an anchor 54 that extends inwardly from the truncated inner corner portion thereof to project laterally from the three inner side walls 56 to present outwardly disposed shoulders 57, 58 and 59. This lateral anchor (54) projection presents inner guide walls parallel with each of the inner walls 56 and offset by the outwardly disposed shoulders 57, 58 and 59, these inner guide walls being joined by three corner edges which are rounded with a generous radius as later described. These inner guide walls closely clear the adjacent anchors 44 as shown. It is these three shoulders 57, 58 and 59 that engage outwardly against the inwardly disposed right angularly related (single line) bearing races 31, 36 and 37, or 32, 34 and 37, or 33, 35 and 37, simultaneously in all three axes X, Y and Z, and moveable with respect to one of said axes at a time.

The legs 16-18, stem 19 and anchors 44 and 54 occupy the spherical cavity 13 with supporting engagement one with the other as they touch adjacently, normally there being slight clearance. It is to be understood that clearances are involved as required, and it is the spring means S that yieldingly holds the blocks in tight interface engagement, as shown. The legs 16–18 and stem 19 continue one into the other to establish right angular center posts against which the inner sides of the edge block anchors 44 can bear (see FIG. 2) with slight clearance. And, the inner sides of the corner block anchors 54 are right angular to bear against the sides of the anchor 44 (with slight clearance as shown). These features ensure a right angular relationship of parts at all times, subject to the spring means S that tightens all said interengagements.

In accordance with this invention, the interfaces of the center block 10, edge block 11 and corner block 12 are cam-shaped at the edges which define their slideably engageable interfaces, whereby any side group of nine blocks will automatically seek alignment with adjacent blocks when rotated with respect to its plane of truncation. In practice, the edges of the blocks are chamfered so as to present inclined planes, and preferably rounded as shown.

Each inner edge of the center blocks 10, normal to the outer face or cover plate 24, is truncated by a cone-shaped radius 60 with a 90° base at the face plane and an apex or smaller end of the cone at the intersection of the bearing races 31–36. A portion of each of the side walls 25–30 remains flat therebetween.

Each inner edge of edge blocks 11, normal to the two outer faces 42 and 43 thereof, is truncated by a cone-shaped radius 61 with a 90° base tangent to the right angularly related side walls 40–46 and 41–46, and side walls 40–45, and 41–45, and an apex or smaller end of each cone at the joinder of said block with its anchor 44. A portion of each of the inner walls 45 and 46 remains flat therebetween.

Each inner edge of corner blocks 12, normal to the three outer faces 55, is truncated by a cone-shaped radius 62 with a 90° base tangent to the right angularly related side walls 56, and an apex or smaller end of the cone at the joinder of said block with its anchor 54.

By forming the chamfers or bevels and preferably as shown as conical radii 60, 61 and 62, substantially all interference is eliminated and replaced with decreasingly inclined planes in the opposite directions of rotation, whereby the alignment of blocks is perfected as rotative movement is applied, during each and every step in the puzzle solution proceedure.

In accordance with this invention, the anchors 44 and 54 are cam-shaped in the direction of rotation, at opposite sides of the anchors. In practice, a 180° radius 63 tangent to the opposite inner guide walls of the anchor 44 extends inwardly from each shoulder 47 and 48. And, a 90° radius 64 tangent to adjacent inner guide walls of anchor 54 extends inwardly from each shoulder 57, 58 and 59. These 90° radii are substantially equal in dimension to the lateral extent of said shoulders. All remaining corner edges throughout the block construction are also generously radiused as at 65, for example a 2 mm radius whereby interferences are eliminated and smooth operation is assured.

Having described only a typical preferred form and application of my invention, I do not wish to be limited or restricted to the specific details herein set forth, but wish to reserve to myself any modifications or variations that may appear to those skilled in the art as set forth within the scope of the following claims.

I claim:

1. A game cube of selectively moveable surface blocks and each side of the cube comprised of a center block, four corner blocks and an edge block adjacent the center block between each pair of corner blocks, the corner and edge blocks of adjacent sides of the cube being common one with the other, a cross disposed within the moveable surface blocks and with oppositely extending legs on three right angularly related axes and means rotatably coupling the center blocks to said cross, the cube being truncated on three parallel pairs of right angularly related planes separating the said moveable surface blocks each with an identifiable face exposed at the exterior of the cube and with adjacent interface sides slideable one against the other, the inner sides of the center blocks and inner edges of the edge blocks together forming a spherical internal cavity with inwardly disposed bearing races at the planes of truncation, there being anchors extending inwardly from the edge blocks and corner blocks and having outwardly disposed shoulders slideable against the bearing races, for separate rotatable movement of groups of blocks comprising each side of the cube, and an interface side of at least one of said surface blocks having an inclined truncated surface with an apex at the bearing race of any one of said center blocks to engage with a next adjacent interface side of a block slideable thereagainst.

2. The game cube of selectively moveable blocks as set forth in claim 1, wherein all interface sides of said surface blocks have inclined truncated surfaces and each with an apex at the bearing race of any one of said center blocks to engage with a next interface side of a block slideable thereagainst.

3. The game cube of selectively moveable blocks as set forth in claim 1, wherein all interface sides of said surface blocks have oppositely inclined truncated surfaces and each with an apex at the bearing race of any one of said center blocks to engage with a next adjacent interface side of a block slideable thereagainst.

4. The game cube of selectively moveable blocks as set forth in claim 1, wherein the interface sides of at least a pair of relatively moveable surface blocks have inclined truncated surfaces and each with an apex at the bearing race of any one of said center blocks and slideably engageable one with the other.

5. The game cube of selectively moveable blocks as set forth in claim 1, wherein the at least one of said surface blocks has a truncated inclined surface with an apex at the bearing race of any one of said center blocks and reducing an inner edge thereof engageable with the next adjacent interface side of the block slideable thereagainst.

6. The game cube of selectively moveable blocks as set forth in claim 1, wherein all of said surface blocks have an inclined truncated surface and each with an apex at the bearing race of any one of said center blocks and reducing the inner edges thereof engageable with the next adjacent interface side of a block slideable thereagainst.

7. The game cube of selectively moveable blocks as set forth in claim 1, wherein all of said surface blocks have oppositely inclined trucated surfaces and each with an apex at the bearing race of any one of said center blocks and reducing opposite inner edges thereof engageable with the next adjacent interface of a block slideable thereagainst.

8. The game cube of selectively moveable blocks as set forth in claim 1, wherein the interface sides of at least a pair of said surface blocks has inclined truncated surfaces and each with an apex at the bearing race of any one of said center blocks and reducing the inner edges thereof and slideably engageable one with the other.

9. The game cube of selectively moveable blocks as set forth in claim 1, wherein the inclined surface is of truncated cone configuration having a base portion at the exterior face of the block and convergent toward a bearing race of said block.

10. The game cube of selectively moveable blocks as set forth in claim 2, wherein the inclined surfaces are of truncated cone configuration having a base portion at the exterior face of the block and convergent toward a bearing race of said block.

11. The game cube of selectively moveable blocks as set forth in claim 3, wherein the inclined surfaces are of truncated cone configuration having a base portion at the exterior face of the block and convergent toward a bearing race of said block.

12. The game cube of selectively moveable blocks as set forth in claim 4, wherein the inclined surfaces are of truncated cone configuration having a base portion at the exterior face of the block and convergent toward a bearing race of said block.

13. The game cube of selectively moveable blocks as set forth in claim 1, wherein the center blocks have inclined surfaces at each of the inner edges thereof and each of a truncated cone configuration having a base portion at the exterior face of the block and convergent toward a bearing race of said block.

14. The game cube of selectively moveable blocks as set forth in claim 1, wherein the center blocks have inclined surfaces at each of the inner edges thereof and each of a truncated cone configuration having a base portion at the exterior face of the block and convergent toward a bearing race of said block, and wherein said base portions continue circumferentially one into the other.

15. The game cube of selectively moveable blocks as set forth in claim 1, wherein the corner blocks have inclined surfaces at three inner corner related edges and each of a truncated cone configuration having a base portion at the exterior face of the block and convergent toward a bearing race of said block.

16. The game cube of selectively moveable blocks as set forth in claim 1, wherein the corner blocks have inclined surfaces at three inner corner related edges and each of a truncated cone configuration having a base portion at the exterior face of the block and convergent toward a bearing race of said block, and wherein said base portions continue into the three inner edge related sides of the block.

17. The game cube of selectively moveable blocks as set forth in claim 1, wherein the edge blocks have inclined surfaces at the inner edges of each of two adjacent exterior faces and each inclined surface of a truncated cone configuration having a base portion at the exterior face of the block and convergent toward a bearing race of said block.

18. The game cube of selectively moveable blocks as set forth in claim 1, wherein the edge blocks have inclined surfaces at two inner edges of each of two adjacent exterior faces and each inclined surface of a truncated cone configuration having a base portion at the exterior face of the block and convergent toward a bearing race of said block, and wherein said base portions continue circumferentially one into the other.

19. The game cube of selectively moveable blocks as set forth in claim 1, wherein the anchors extending inwardly from the edge blocks and corner blocks present inner guide walls closely clearing the legs of the cross and each other through inner edge radii substantially equal in dimension to the lateral extent of the anchors respectively.

20. The game cube of selectively moveable blocks as set forth in claim 1, wherein the anchors extending inwardly from the edge blocks and corner blocks present inner guide walls closely clearing the legs of the cross and each other through inner edge radii, the inner edge radii of the corner blocks being 90° and substantially equal in dimension to the lateral extent of said anchor shoulders thereof.

21. The game cube of selectively moveable blocks as set forth in claim 1, wherein the anchors extending inwardly from the edgeblocks and corner blocks present inner guide walls closely clearing the legs of the cross and each other through inner edge radii, the inner edge radii of the edge blocks being 180° and equal in dimension to the spacing of opposite inner sides of said anchor thereof.

22. The game cube of selectively moveable blocks as set forth in claim 1, wherein the anchors extending inwardly from the edge blocks and corner blocks present inner guide walls closely clearing the legs of the cross and each other through inner edge radii, the inner edge radii of the corner blocks being 90° and substantially equal in dimension to the lateral extent of said anchor shoulders thereof, and the inner edge radii of the edge blocks being 180° and equal in dimension to the spacing of opposite inner sides of said anchor thereof.

* * * * *